United States Patent [19]

Friedrich

[11] 4,318,497

[45] Mar. 9, 1982

[54] CORRUGATED SHIPPING CONTAINER FOR VISCOUS REFRACTORY SLURRIES AND DISCHARGE APPARATUS THEREFOR

[75] Inventor: James F. Friedrich, Westmont, Ill.

[73] Assignee: Nalco Chemical Company, Oak Brook, Ill.

[21] Appl. No.: 162,011

[22] Filed: Jun. 23, 1980

[51] Int. Cl.[3] ..... B65D 77/06

[52] U.S. Cl. ..... 222/83; 222/105

[58] Field of Search ..... 222/105, 83, 83.5, 88, 222/91, 81

[56] References Cited

U.S. PATENT DOCUMENTS

| | | | |
|---|---|---|---|
| 2,861,718 | 11/1958 | Winzen | 222/105 |
| 3,171,571 | 3/1965 | Daniels | 222/105 X |
| 3,239,104 | 3/1966 | Scholle | 222/81 |
| 4,165,024 | 8/1979 | Oswalt et al. | 222/105 |

*Primary Examiner*—Stanley H. Tollberg

*Attorney, Agent, or Firm*—Lloyd L. Zickert

[57] ABSTRACT

A combination shipping container and discharge apparatus for handling viscous refractory slurries, including a container of rigidized corrugated board mounted on a pallet and a discharge apparatus attachable to the container side wall and penetrating the side wall to define a discharge opening for the container.

10 Claims, 17 Drawing Figures

CORRUGATED SHIPPING CONTAINER FOR VISCOUS REFRACTORY SLURRIES AND DISCHARGE APPARATUS THEREFOR

This invention relates in general to a combination shipping container and discharge apparatus for handling liquids and particularly viscous slurries from the point of manufacture to the point of use, and more particularly to a disposable corrugated board shipping container and a discharge apparatus attachable to the container for emptying the contents of the container.

Heretofore, viscous refractory liquids or slurries used as repair or sealant material for steel ingot molds and stools used to produce steel ingots have been packaged and shipped in 55 gallon steel drums. The repair material serves to repair worn molds and stools while the sealant serves to seal between a mold and stool. Such repair and sealant materials are well known and available as products from Nalco Chemical Company of Chicago, Ill. At the place of use, such as a steel ingot producing plant, the steel drums are emptied into an elevated hopper from which the refractory slurry is gravitationally dispensed to pumps for redistribution to the areas of use. Thereafter, disposal of the empty steel drums must be accomplished. The cost of the steel drums and the hopper system for handling the refractory slurry is substantial, and is a relevant part of the ultimate cost of the slurry to the customer. Disposal of the steel drums also creates a cost problem.

The combination container and discharge apparatus of the present invention overcomes the difficulties heretofore encountered in the handling of viscous refractory slurries in that the slurry is packaged in a container constructed of rigidized corrugated board which can be easily disposed of in burning or recycling operations. The container packages the slurry and serves as a shipping, storage and dispensing container, thereby eliminating the need of any other support system for using the slurry. Thus, the slurry is loaded directly into the container at the place of slurry manufacture, and dispensed directly from the container at the place of ultimate usage.

The discharge apparatus of the present invention is maintained at the place of use and there easily mounted onto the container for effecting the discharge of the container contents. Following emptying of the container, the discharge apparatus is removed from the container and successively used on loaded containers.

More specifically, the container includes a box of rigidized corrugated board having a rigidized corrugated board liner for the side walls and a plastic bag liner therein into which the slurry is placed when filling the container. Following the loading of the plastic bag, it is closed off at the top and the flaps of the box are closed, after which the loaded container is then suitably attached to a pallet which facilitates handling of the container. A protective cover is applied over the container and fastened in place in order to prevent exposure of the container to weather or other conditions detrimental to the integrity of corrugated board. At the place of use, the cover is removed and a first part of the discharge apparatus in the form of a mounting plate is secured to the container near the bottom. A guide member is then attached to the mounting plate. A discharge fitting or spout is then mounted on the container and connected to the mounting plate. The guide member guides the mounting of the spout, and as the spout is being mounted, it seals against loss of contents. The discharge spout punctures the side wall of the container to provide a passage from within the container to the spout, which is in turn connected to suitable piping for delivering the contents to the ultimate place of usage. During emptying of the contents, the container and pallet are placed on an inclined platform to assist in the gravitational discharge of the contents through the spout to the piping connected thereto. Following emptying of the container, the discharge apparatus is removed for further use on another container, and the container and pallet is disposed of in a suitable manner.

The invention thereby eliminates the need to dispose of any steel drums and also eliminates the need for a hopper system as the contents of the container are directly discharged from the container to a piping or conduit system enabling use of the slurry for stool repair.

It is therefore an object of the present invention to provide a new and improved combination shipping container and discharge apparatus for handling viscous refractory liquids or slurries and particularly for facilitating the shipping, storing and delivering of the slurry to the point of use.

A further object of the present invention is in the provision of a combination corrugated shipping container and a reusable discharge apparatus therefor for handling heavy viscous refractory slurries and permits use of contents directly from the container, thereby providing a handling and usage system of much lower cost to reduce the overall cost of the slurries, and which eliminates the need for heretofore known hopper systems.

Another object of the present invention resides in the provision of a combination shipping container and discharge apparatus for viscous refractory slurries which reduces the cost of packaging and assists the user in handling the slurries.

A still further object of this invention is in the provision of a combination shipping container and discharge apparatus for handling viscous slurries wherein the container is constructed of rigidized corrugated board and is easily disposable, while the discharge apparatus is reusable for subsequent filled containers.

Other objects, features and advantages of the invention will be apparent from the following detailed disclosure, taken in conjunction with the accompanying sheets of drawings, wherein like reference numerals refer to like parts, in which.

Figure 16:
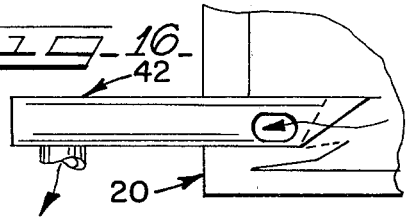
Figure 17:
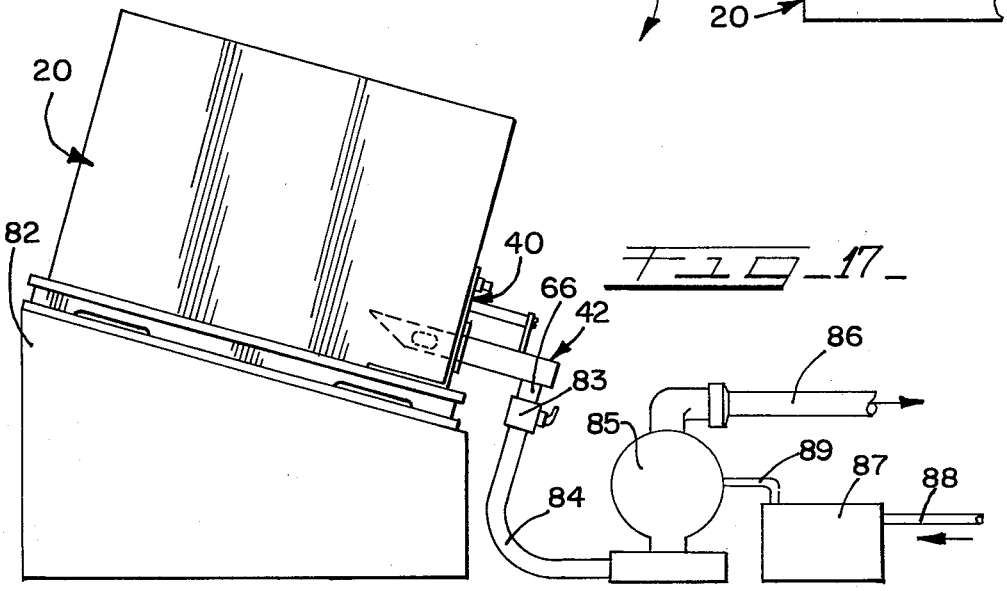

FIGS. 9 to 16 are schematic side elevational views illustrating sequentially the step-by-step insertion of the discharge spout into the container and the manner in which the contents flow from the container through the discharge spout; and FIG. 17 is a somewhat diagrammatic side elevational view of the combination container discharge apparatus according to the invention as it is connected to fittings and pumps for effecting use of the material and as the invention is arranged when the contents are being emptied.

Figure 1:
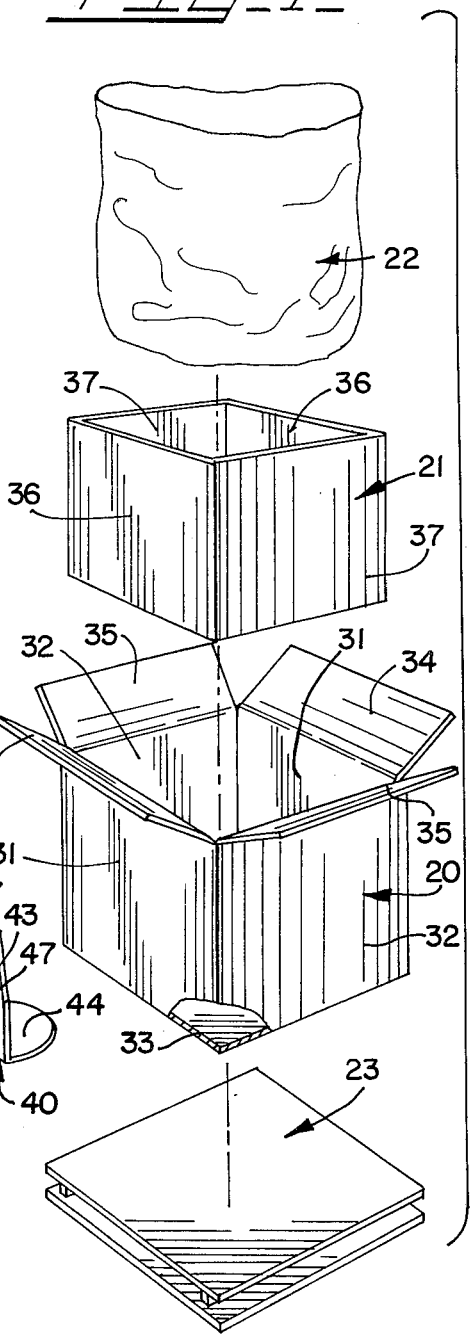
FIG. 1 is an exploded view of the shipping container and the discharge apparatus of the present invention with some parts omitted for purposes of clarity.
Figure 4:
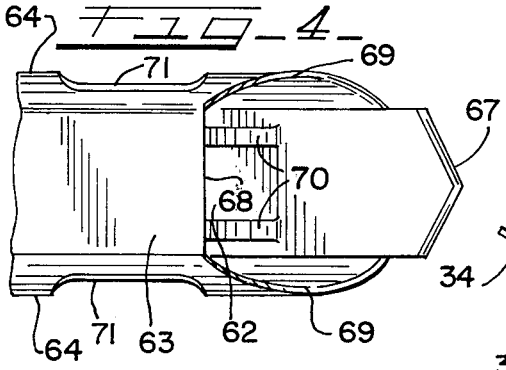
FIG. 4 is a fragmentary bottom plan view of the leading end of the discharge fitting or spout taken generally along line 4—4 of FIG. 3.
Figure 4:
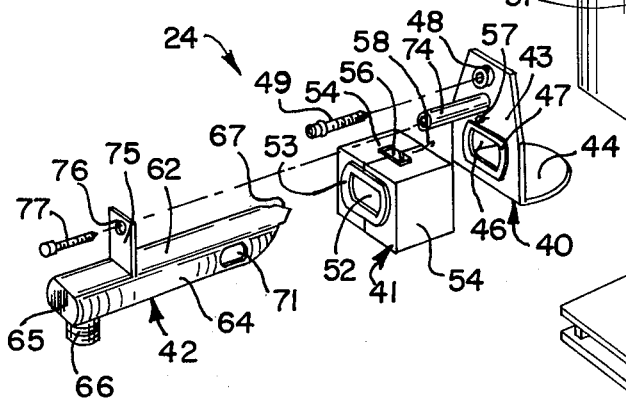

Referring now to the drawings and particularly to FIG. 1, the combination shipping container and discharge apparatus of the invention is illustrated in exploded form wherein the container essentially includes a rigidized corrugated box 20, a rigidized corrugated liner 21, a heavy-duty plastic bag 22, and a conventional pallet 23. The discharge apparatus which is secured to the container when it is desired to use the contents of the container is shown generally by the numeral 24.

Figure 2:
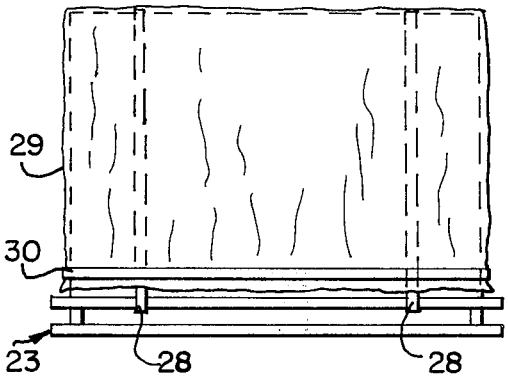
FIG. 2 is an elevational view of the container of the present invention after it is assembled, filled and readied for shipment.

Additional elements becoming a part of the container when it is shipped and not illustrated in FIG. 1 are shown in FIG. 2, which include strapping 28 for attaching the box 20 with the liner and plastic bag and its contents to the pallet 23, a weatherproof cover 29, and a band 30 for retaining the cover 29 in place.

Filling and preparing the container for shipment is accomplished by placement of the box 20 onto the pallet 23, by insertion of the liner 21 into the box, and insertion of the plastic bag 22 within the box and the liner. Thereafter, viscous refractory slurry is loaded into the bag which then is suitably tied off at the top such as by a tie member, after which the flaps of the box are closed. Strapping 28 is then applied to securely connect the box and its contents to the pallet and to additionally maintain the flaps in closed position, after which the weatherproof cover 29 is applied and retained in place by the band 30. The container of slurry is then ready for shipment.

The box 20 is constructed of a rigidized corrugated board of about one inch in thickness and includes rectangularly arranged upstanding opposed walls 31, 31 interconnected with upstanding opposed walls 32, 32, a bottom wall 33 connected to the opposed upstanding walls, opposed closing flaps 34, 34 at the upper ends of the upstanding opposed walls 31, 31 and opposed closing flaps 35, 35 on the upper ends of the opposed walls 32, 32. The bottom wall 33 may be constructed of flaps which would be in closed position or it may be constructed in any other desirable manner which generally provides a single thickness on the bottom wall. The strength of the bottom wall is enhanced by the pallet on which it sits. It will be appreciated that the boxes 20 would be normally received in knocked-down form and erected at the time of use when the slurry manufacturer sets up the container for filling purposes.

The liner 21 is also constructed of rigidized corrugated board of about one inch in thickness and is in generally sleeve shape and includes opposed upstanding side walls 36, 36 interconnected to opposed upstanding side walls 37, 37. The liner 21 serves to give additional reinforcing strength to the side walls of the box 20 which are subjected to the weight of the contents and is sized so that it fits within the box in mating relation with the box side walls. Further, it would be of substantially the same height as the box side walls.

Plastic bag 22 is in the form of a liner for the container which is waterproof and can contain the slurry and prevent the slurry from coming in contact with the corrugated board of the liner and/or box. It may be constructed of any suitable plastic preferably of about 6 mil thickness and would be sized so that it fits within the container and liner in contact with the bottom of the box and the side walls of the liner with ample excess at the top that can be tied together once the container has been filled with slurry. The usual type of wire or the like tying member may be used to tie the upper end of the bag together, after which the closure flaps would be folded into closed position in the usual manner. It may be appreciated that the strapping 28 would maintain the closure flaps in closed position although if desired, the closure flaps may be adhesively secured in closed position or taped in closed position. The strapping 28 may be of any suitable metal or plastic type which would be sufficient to withstand the necessary forces involved to maintain the box and its contents in secured relation to the pallet 23.

The pallet 23 may be constructed of wood or other materials that are generally used in order to provide the desired structural integrity and a rigidity that would satisfy the loads involved in the shipment of slurries. For example, one proposed structure of a container according to the invention would involve a box that is 44 inches square and 30 inches high and, when filled, would contain about 3,000 pounds of slurry. Accordingly, the pallet would necessarily be constructed to handle such a weight and be sized slightly larger than the box bottom wall, as illustrated in the drawings. Further, the materials of the pallet may be such that they can be disposed of with the container after the container has been emptied. However, it should be appreciated that the pallet could be saved if desired by disconnecting the box from the pallet so the pallet could be reused.

Plastic cover 29 need not be of the same strength as the plastic bag liner 21 as it will be subjected to lighter forces than the plastic bag. In effect, the cover 29 may be of any suitable material but preferably of plastic such as about 3 mil in thickness, and it will generally take the form of an inverted bag which can be applied over the top of the box after it has been filled and strapped to the pallet.

The material for band 30 may be of any suitable type so long as it has sufficient strength to hold the bag in place on the box during shipment. Preferably, the size of the cover 29 will be such that it comes down to the pallet 23 so that the entire corrugated board box is protected against the weather. Such a packaged material will be shipped on flat bed trucks or railroad cars where they would be exposed to the weather. Therefore, the plastic cover 29 would be used to protect the corrugated board against the weather.

Figures 3, 5, 6, 7, 8:
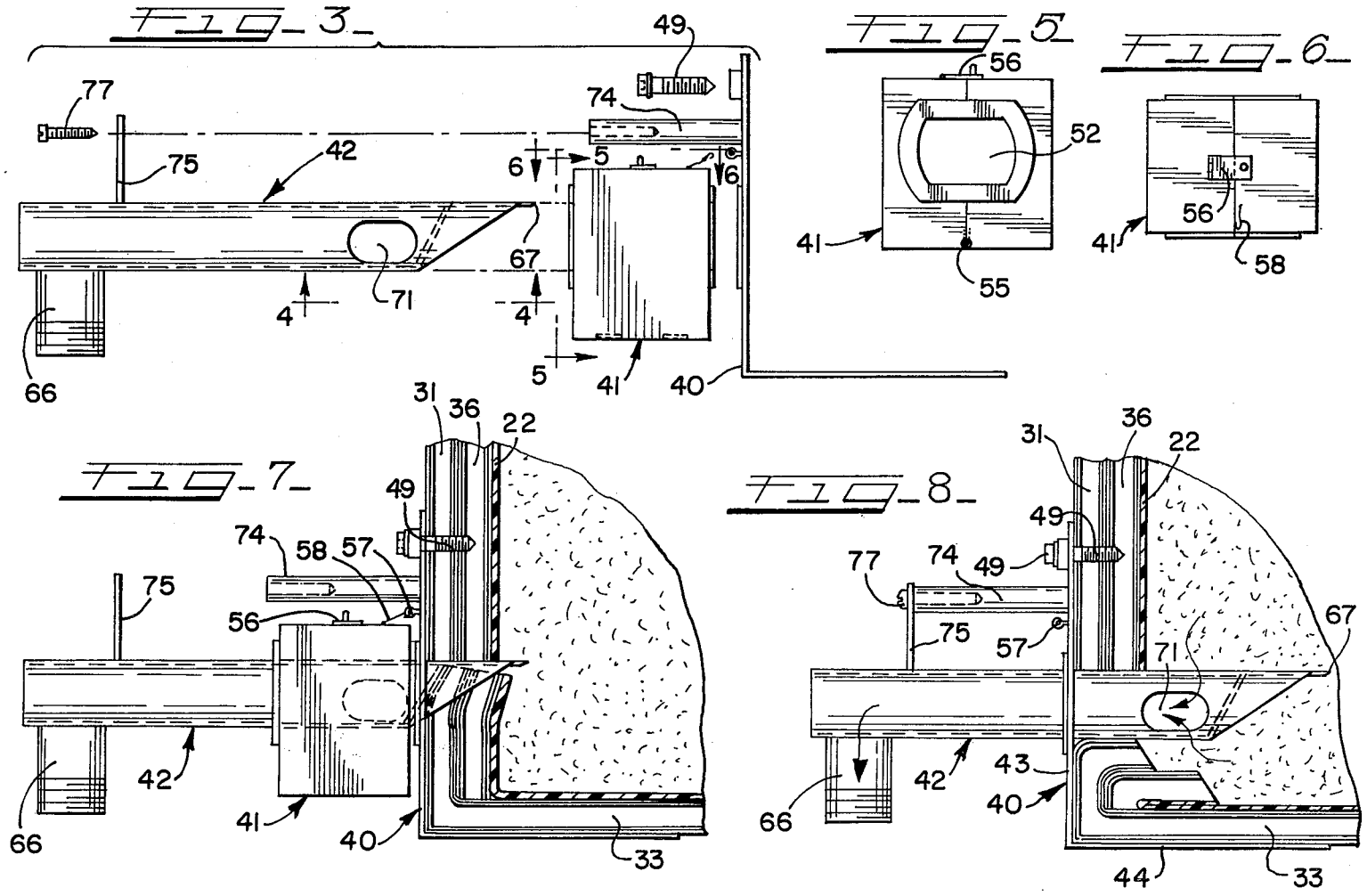
FIG. 3 is an exploded side elevational view of the discharge apparatus according to the invention, including the mounting plate, the guide and seal member and the discharge spout.
FIG. 5 is a front elevational view of the guide and seal member which is attachable to the mounting plate and taken generally along line 5—5 of FIG. 3.
FIG. 6 is a top plan view of the guide and seal member taken generally along line 6—6 of FIG. 3.
FIG. 7 is a greatly enlarged fragmentary sectional view of part of the container and a side elevational view of the mounting plate attached to the container, the guide and seal member attached to the mounting plate, and the discharge spout partially inserted into the container.
FIG. 8 is a greatly enlarged fragmentary sectional view of a part of the container and a side elevational view of the discharge apparatus attached thereto and readied for discharging the contents of the container for use and with the guide and seal member removed.
Figure 9:
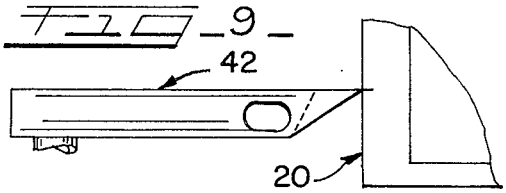
Figure 13:
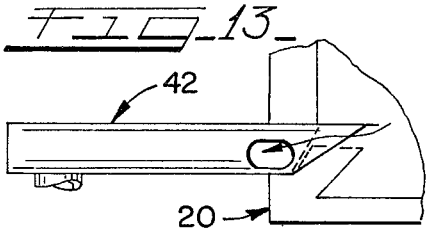
Figure 10:
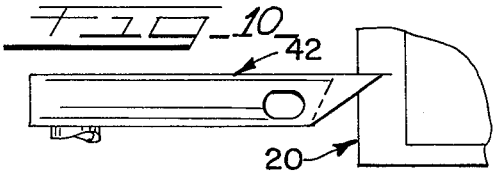
Figure 14:
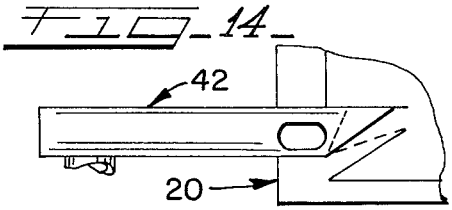
Figure 11:
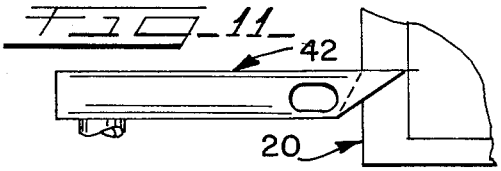
Figure 15:
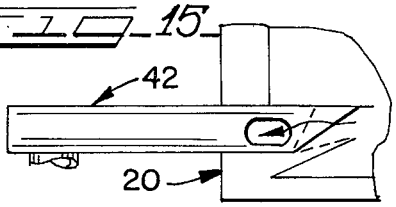
Figure 12:
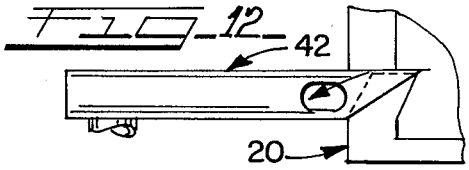

The discharge apparatus 24 generally includes a mounting plate 40 adapted to be attached to the side of the container adjacent the bottom, a guide and seal member 41 adapted to be detachably supported on the mounting plate, and a discharge spout 42 which coacts with the mounting plate and the guide and seal member when it is inserted into the container for puncturing the side wall of the container to form an opening and connecting the interior of the container to the spout for discharge of the contents. Following the insertion of the spout, the guide and seal member is removed, as seen in FIG. 8. While the mounting plate illustrated is formed to fit on a side wall, it could be formed to fit at a corner of the container.

The mounting plate 40 is L-shaped and includes an upstanding wall 43 and a horizontal wall or flange 44. The upstanding wall 43 would lie against a side wall of the container 20, while the flange 44 would be positioned along the underside of the bottom wall 33 and between it and the pallet to support the upstanding wall. An opening 46 is formed in the upstanding wall 43 and provided with a seal or gasket 47 to seal with the discharge spout when it is in place and prevent the leakage of fluid between the plate and the discharge spout. It will be appreciated that the seal 47 and other seals hereafter referred to may be made of a suitable resilient material such as synthetic or natural rubber or a plastic. A boss 48 is provided at the upper end of the upstanding wall 43 and includes an opening thereto for receiving a screw-threaded fastener 49 to attach the mounting plate to the container. Preferably, the fastener 49 would be of the self-tapping type and it is sized in length so that it will penetrate the wall of the box 20 and partially a panel of the liner 21, as illustrated in FIGS. 7 and 8, but be short of engaging or possibly puncturing the plastic bag 22. It can readily be appreciated that in making the discharge apparatus operational, it is first necessary to secure the mounting plate 40 to the container 20, and when it is fastened in place, the guide and seal member 41 can then be attached to the mounting plate.

The guide and seal member 41 is somewhat tubular in shape and also box shaped in that it is hollow and provided at opposite ends with openings 52 like the opening 46 in the mounting plate, and when the member is attached to the mounting plate, the openings 52, being of the same size as opening 46, will align with the opening 46. Similarly, the openings 52 are provided with seals or gaskets 53 so as to seal with respect to the discharge spout 42 when it is received by the guide and seal member. The guide and seal member 41 is sectionally structured on its longitudinal axis and includes mating halves 54 which are hinged together along the bottom by the hinges 55 and connectable at the top by means of a clasp device 56. Thus, release of the clasp 56 would allow opening of the halves at the hinge 55, as it is necessary to do this when the guide and seal member is removed following the insertion of the discharge spout 42. The guide and seal member 41 is supported on the mounting plate 40 by means of a hook and eye support device, which includes an eye member 57 fastened to the mounting plate and a hook member 58 fastened to the guide and seal member 41. After the guide and seal member 41 is fastened in place on the mounting plate 40, the discharge spout 42 can then be mounted on the container.

The discharge spout 42 is an elongated tubular member somewhat rectangular in cross section, open at the leading end and closed at the trailing end. It will be understood that the leading end is the end that punctures the container when the spout is properly mounted on the container. Also, the leading end includes knife edges which facilitate the puncturing of the corrugated board of the container and also the liner of the container and the plastic bag liner. More specifically, the tubular body includes top and bottom opposed walls 62 and 63 and opposed side walls 64. The top and bottom walls are flat, while the opposed walls are arcuate in cross section to give the spout a somewhat oval or rectangular cross-sectional configuration. However, it should be appreciated that the cross-sectional configuration of the spout may take any desired geometrical form. The trailing end of the body is closed by an end wall 65, and at the bottom wall 63 an outlet fitting 66 is provided for connection to suitable plumbing.

At the leading end of the body, which is open, a knife edge 67 is defined at the upper wall 62 with a pointed central portion to facilitate the cutting or puncturing of the container side wall and the liner as the discharge spout is driven into the container. Alternately, the knife edge could be at one or more of the side walls or the bottom wall. The knife edge 67 is offset considerably ahead of the leading edge 68 of the bottom wall 63, and the leading edges 69 of the opposed side wall 64 are slanted from the knife edge 67 to the leading edge 68 of the bottom wall. The knife edge 67 juts ahead of the upper ends of the side wall leading edges 69 so that the corrugated board is first penetrated by the knife edge prior to engagement by the leading edges 69 of the opposed side walls. Spaced rearwardly of the leading knife edge 67 and connected to the upper and lower walls 62 and 63 of the spout are a pair of pusher bars 70 which function to assist in opening the hole in the container side wall and the liner upon the driving of the discharge spout into the container. These pusher bars, while shown to be a pair, could be any number which would provide the necessary assistance in opening a hole in the container and liner. Further, they are arranged at an incline so that they effectively cam the engaged corrugated board gradually during driving of the spout into the container. Inasmuch as the opening for the container is first penetrated and cut by the knife edge at the top part of what will be the opening, the bars are slanted downwardly and rearwardly so that they first engage the corrugated board near the cut portion accomplished by the leading knife edge.

To assist in the free flow of the contents into the leading end of the discharge spout, a pair of openings 71 are provided in opposed relation in the side walls 64 at a point rearward of the leading opening in the spout. As seen particularly in FIG. 8, when the spout is in fully inserted position, the openings 71 are positioned just inside the container so that the contents flowing from the container not only flow through the leading opening but also the openings 71. It may be appreciated that any number of openings may be provided in the body of the discharge spout, and that they may also be provided alternatively in the top and bottom walls if desired.

In order to properly locate the discharge spout so that the openings 71 are positioned inside the container when the spout is fully inserted, a stop is provided which includes a rod 74 extending from the mounting plate 40 above the opening 46 and below the boss 48 to coact with a stop flange 75 extending upwardly from the top wall 62 of the discharge spout 42. Thus, when the stop flange 75 engages the end of the stop rod 74, the discharge spout is properly inserted into the container so that the openings 71 are immersed in the contents and provide additional flow channels for emptying the contents. Also, it is important once the discharge spout is inserted that it be held in place during emptying of the container. Accordingly, a threaded opening is provided in the end of the stop rod 74 which will align with a hole 76 in the flange 75 through which a fastener 77 may be inserted and anchored in the threaded opening to thereby lock the discharge spout in place as illustrated in FIG. 8.

The mounting of the discharge apparatus on a container and readying the discharge apparatus for emptying the contents is accomplished by first attaching the mounting plate 40 onto the container. When it is properly positioned on the container and fastened thereto by the fastener 49, the guide and seal member 41 is then supportably attached in place on the mounting plate 40. It will be appreciated that the guide and seal member 41 is in its closed position relative to the opposite halves, as shown in FIG. 1, and that the gaskets or seals 53 are in place on the openings 52. The gaskets 53 at the leading end of the member will mate and seal also with the gasket 47 on the mounting plate. Lastly, the discharge spout is driven into the container through the guide and seal member 41 and the mounting plate. It will be appreciated that as it is driven into the container and because of the flow path between the leading open end and the side openings 71 which would allow leakage of the contents prior to the discharge spout being fully driven into place inasmuch as at one point therealong, as illustrated in the sequential steps of insertion of the discharge spout in FIGS. 9 to 16 and particularly in FIGS. 12 and 13 and also FIG. 7, the contents could spill out. Thus, the guide and seal member 41, which not only guides the insertion of the discharge spout 42, serves to prevent leakage because the openings 71 will be at least within the seal member 41 at the time when the contents of the container start to flow into the leading open end of the discharge spout. It will be appreciated that when the discharge spout is driven into the container, the outlet fitting 66 will be connected to the plumbing and perhaps with a shutoff valve in order to prevent loss of the contents. Normally, the plumbing would be connected to the discharge spout as illustrated in FIG. 17 during the time the discharge spout is being driven into place in the container. Once the discharge spout is seated and fastened in place by the fastener 77, the guide and seal member 41 may be removed. The clasp 56 is opened to allow the halves 54 of the guide and seal member to be separated on a hinge 55 so that the member can be removed from the discharge spout. Insertion of the discharge spout causes the formation of a flap of corrugated board from the container side wall and the liner which is driven by action of the spout insertion against the bottom wall of the container. In this position as illustrated in FIGS. 8 and 16, the flap is held against the bottom wall to prevent possible loosening and movement into the discharge spout, which, if happened, might clog the spout to prevent or at least inhibit flow of the contents from the container.

During emptying of the container, it is inclined as illustrated in FIG. 17 on a suitable support 82 so that the slurry can be gravitationally discharged from the container. It has been found that if the container is inclined from the horizontal about 15 degrees, that is sufficient to effect the suitable gravitational discharge of the contents. A shutoff valve 83 is secured to the outlet fitting 66 of the discharge spout, and in turn connected to a pipe or line 84. The pipe 84 is connected to the inlet of a diaphragm or other suitable pump 85 for transporting liquid materials. The outlet of the pump is connected to piping 86 which would in turn be connected to a nozzle or the like to enable the user to apply the slurry to an ingot stool or mold. In order to provide air amplification for the material, a booster pump 87 is employed, having an air inlet 88 and an air outlet 89 connected to the pump 85.

Following the emptying of the contents of the container, it will be appreciated that the discharge apparatus 24, which now only consists of the discharge spout 42 and the mounting plate 40, would be removed from the container for reusage, and the container with the pallet may then be disposed of in any suitable manner. It should be appreciated that the pallet may be separated from the container for reusage if desired. The container could either be incinerated or recycled with or without the pallet in accordance with the desires of the user. Subsequently, the discharge apparatus could be reused on another container.

From the foregoing, it can be appreciated that the combination container and discharge apparatus of the present invention reduces the overall cost of refractory slurries and assists in the handling of the slurries by the user. The time for handling the slurry is reduced, thereby reducing labor costs.

It will be understood that modifications and variations may be effected without departing from the scope of the novel concepts of the present invention, but it is understood that this application is to be limited only by the scope of the appended claims.

The invention is hereby claimed as follows:

1. A combination container and discharge apparatus for a viscous refractory slurry, said container including:

a box of rigidized corrugated board having a bottom wall, opposed upright side walls extending from the bottom wall, and closure flaps at the upper ends of the side walls, a liner of rigidized corrugated board having opposed upright panels of substantially the same size as the side walls and in juxtaposition therewith, a plastic bag within the liner within which the slurry is contained, a pallet disposed beneath the box, and strapping means connected to the pallet and extending over opposed side walls and the closure flaps to fasten the filled box onto the pallet;

said discharge apparatus including:

a mounting plate attachable to the box and having an opening therethrough, said opening having seal means, a guide and seal member attachable to said mounting plate, and a tubular discharge spout having a discharge opening and coacting with the mounting plate seal means and the guide and seal member when mounted on the container, said spout having a knife edge for penetrating the container during insertion through the box, liner and plastic bag to interconnect the interior therewith and having a discharge opening.

2. The combination defined by claim 1, wherein the container further includes a liner of rigidized corrugated board having opposed upright panels of substantially the same size as the side walls and in juxtaposition therewith.

3. The combination defined by claim 2, wherein the container further includes a cover over the box to protect it from weather.

4. The combination defined by claim 3, wherein the cover is in the form of a plastic bag arranged in inverted position on the box, and means is provided to retain the cover in place on the box.

5. The combination defined by claim 1, wherein said mounting plate is L-shaped to fit against a side wall and the bottom wall.

6. A combination container and discharge apparatus for a viscous refractory slurry, said container including:

a box of rigidized corrugated board having a bottom wall, opposed upright side walls extending from the bottom wall, and closure flaps at the upper ends of the side walls, a liner of rigidized corrugated board having opposed upright panels of substantially the same size as the side walls and in juxtaposition therewith, a plastic bag within the liner within which the slurry is contained, a pallet disposed beneath the box, and strapping means fastening the filled box onto the pallet;

said discharge apparatus including:

an L-shaped mounting plate having an opening therethrough and attachable to the box against a side wall and the bottom wall, said opening having seal means, a guide and seal member attachable to said mounting plate, said guide and seal member including a longitudinally sectioned tubular body having openings at both ends receiving seals for coacting with the discharge spout to prevent leakage during puncturing of the container by the spout, and a tubular discharge spout coacting with the mounting plate seal means and the guide and seal member when mounted on the container and having a knife edge for penetrating the container during insertion to interconnect the interior therewith and having a discharge opening.

7. The combination defined by claim 6, wherein said discharge spout includes a tubular body open at one end and closed at the other end and having outlet means for connection to piping, and means for connecting the spout to the mounting plate.

8. A combination shipping and handling container and discharge apparatus therefor for a viscous refractory slurry, said container including:

a box of rigidized corrugated board having a bottom wall, opposed upright side walls extending from the bottom wall, and closure flaps at the upper ends of the side walls, a liner of rigidized corrugated board having opposed upright panels of substantially the same size as the side walls and in juxtaposition therewith, a plastic bag liner within the corrugated board liner closable at the top when filled with slurry, a pallet onto which the box is mounted, strapping means securing the box to the pallet, and a protective cover over the box, said discharge apparatus including:

a mounting plate having an opening with a seal member, means for securing the mounting plate to the box at the lower end thereof to generally align the opening just above the bottom of the box, a guide and seal member of tubular shape for attachment to said mounting plate and having openings with seal members aligned with the opening of the mounting plate, and a discharge spout of tubular shape telescopically receivable in the openings of said guide and seal member and said mounting plate, knife means at the leading end of the discharge spout for cutting a hole in the box when the spout is seated relative the mounting plate.

9. The combination defined by claim 8, wherein the discharge apparatus includes means to secure the discharge spout into seated relation with the mounting plate.

10. The combination defined by claim 9, wherein said guide and seal member is longitudinally sectioned so that it can be removed from the discharge spout when the spout is in discharge position.

* * * * *